United States Patent [19]

Caires

[11] Patent Number: 4,540,369

[45] Date of Patent: Sep. 10, 1985

[54] COUNTERROTATING DUAL-PROPELLER BOAT DRIVE

[76] Inventor: Richard Caires, 301 E. 75th St., New York, N.Y. 10021

[21] Appl. No.: 468,302

[22] Filed: Feb. 22, 1983

[51] Int. Cl.[3] ..... B63H 5/10

[52] U.S. Cl. ..... 440/81; 440/89; 416/93 A; 416/129

[58] Field of Search ..... 416/93 A, 128, 129, 416/127; 440/81, 80, 89; 74/750 R, 801

[56] References Cited

U.S. PATENT DOCUMENTS

| | | | |
|---|---|---|---|
| 1,360,037 | 11/1920 | Shonnard | 440/80 X |
| 1,381,939 | 6/1921 | Small | 416/129 |
| 2,672,115 | 3/1954 | Conover | 440/80 |
| 3,467,051 | 9/1969 | Shimanckas | 416/93 A |

*Primary Examiner*—Sherman D. Basinger
*Attorney, Agent, or Firm*—Michael J. Striker

[57] ABSTRACT

A propeller assembly is usable in combination with a watercraft drive unit having a generally horizontal drive support tube fixed on the craft and a drive shaft projecting from the rear end of the support and rotatable about a drive axis. The drive assembly has a hub fixed on the shaft adjacent the support and having a front hub portion immediately behind the rear support end and a rear end spaced therefrom. A rear propeller is fixed to the rear portion of the hub so that it rotates therewith and with the shaft. A planet carrier defining a plurality of planet axes parallel to and spaced equiangularly about the drive axis is secured to the support so the planet axes are fixed relative to the support and drive axis. A sun gear fixed on the front portion of the hub within the planet axes meshes with respective planet gears rotatable on the carrier about the planet axes. A front propeller surrounds the planet gears, lies between the rear propeller and the rear support end, and is formed internally as a sun gear meshing with the planet gears. Thus rotation of the drive shaft in one direction rotates the rear propeller and sun gear in the same direction and rotates the planet gears and front propeller in the opposite direction.

8 Claims, 2 Drawing Figures

COUNTERROTATING DUAL-PROPELLER BOAT DRIVE

FIELD OF THE INVENTION

The present invention relates to a propeller drive for a boat. More particularly this invention concerns a counterrotating dual-propeller drive for use with an inboard, inboard/outboard, or outboard-motor drive of a watergoing vessel.

BACKGROUND OF THE INVENTION

It is known to provide dual counterrotating propellers as the water-engaging drive element on a boat. The two propellers are of opposite hand but normally otherwise identical and are rotatable about the same axis immediately adjacent each other at the stern of the boat. Using two propellers reduces vibration, increases thrust, and eliminates reverse torque effective from the drive on the craft.

As described in U.S. Pat. No. 3,087,553 of Kostyun the rear propeller is fixed on the drive shaft and the front propellor is journaled on a fixed support tube coaxial with the rear shaft. Bevel gears rotatable about radial axes mesh with gear rings on the back and front edges of the front and rear propellers, respectively, so that the rotation of the front propeller is identical to but perfectly opposite that of the rear propeller.

Such an arrangement is fairly complex. The intermediate drive gears are fully exposed and liable to fouling so they wear rapidly. Furthermore retrofitting the system on an existing drive intended for use with a single propeller is difficult, particularly when the exhaust is discharged through the drive shaft, as is common.

Similarly it is standard to mount such counterrotating dual-propeller drives on torpedoes, principally because a single prop would rotate such a small submarine craft about its own axis. As described in U.S. Pat. No. 2,765,040 of Darrah, however, these arrangements are complex in the extreme and absolutely unfit for retrofitting on any standard drive.

The use of counterrotating propellers in aircraft is also well known, both in a helicopter as described in U.S. Pat. No. 3,933,324 of Ostrowski as well as in airplanes as described in U.S. Pat. Nos. 2,305,454, 2,322,394, and 2,406,460 respectively of Nallinger, Sharpe, and Guerke. All such systems are wholly unsuitable for watercraft.

In general the systems for driving counterrotating coaxial drive elements are quite complex. U.S. Pat. Nos. 2,543,453 and 3,646,834 respectively of Fuller and Davis evidence this complexity. As a result counterrotating dual propellers are virtually unknown on standard small pleasure craft, and have never been meaningfully applied to small outboard-motor drives at all.

OBJECTS OF THE INVENTION

It is therefore an object of the present invention to provide an improved counterrotating dual-propeller drive system for a watercraft.

Another object is the provision of such a counterrotating dual-propeller drive system for a watercraft which overcomes the above-given disadvantages.

A further object is to provide such a drive which can easily be retrofitted on an existing drive tube and shaft, even one in which the exhaust gases are vented through this structure.

SUMMARY OF THE INVENTION

These objects are attained according to the instant invention in a propeller assembly usable in combination with a watercraft drive unit having a generally horizontal and annular drive support fixed on the craft and a drive shaft projecting from the rear end of the support and rotatable about a drive axis. The drive assembly has a hub fixed on the shaft adjacent the support and having a front hub portion immediately behind the rear support end and a rear end spaced therefrom. A rear propeller is fixed to the rear portion of the hub so that it rotates therewith and with the shaft. A planet carrier defining a plurality of planet axes parallel to and spaced equiangularly about the drive axis is secured to the support so the planet axes are fixed relative to the support and drive axis. A sun gear fixed on the front portion of the hub within the planet axis meshes with respective planet gears rotatable on the carrier about the planet axes. A front propeller surronds the planet gears, lies between the rear propeller and the rear support end, and is formed internally as a ring gear meshing with the planet gears. Thus rotation of the drive shaft in one direction rotates the rear propeller and sun gear in the same direction and rotates the planet gears and front propeller in the opposite direction.

According to this invention the sun gear is unitarily formed on the hub. This makes the drive according to this invention quite simple in construction and, therefore, trouble-free in use. In addition according to the invention the drive support forms a rearwardly directed exhaust port and the planet carrier, planet gears, and rear prop form at least one axially throughgoing passage aligned with the port. Thus exhaust can be vented axially through the drive. This makes the system applicable even to standard below-water exhaust arrangements, something hitherto unattainable with the complex dual-prop drives of the prior art.

The support means for the planet carrier includes a rigid support tube snugly and coaxially surrounding the drive support. In addition it includes an axial-thrust between the front propeller and the support tube. Another such bearing is provided between the rear end of the front propeller and a mounting ring which may form part of the planet carrier.

The sun gear according to this invention is integrally formed on the front hub portion. Thus the structure is extremely simple and trouble-free.

DESCRIPTION OF THE DRAWING

The above and other features and advantages will become more readily apparent from the following, reference being made to the accompanying drawing in which.

SPECIFIC DESCRIPTION

Figure 1:
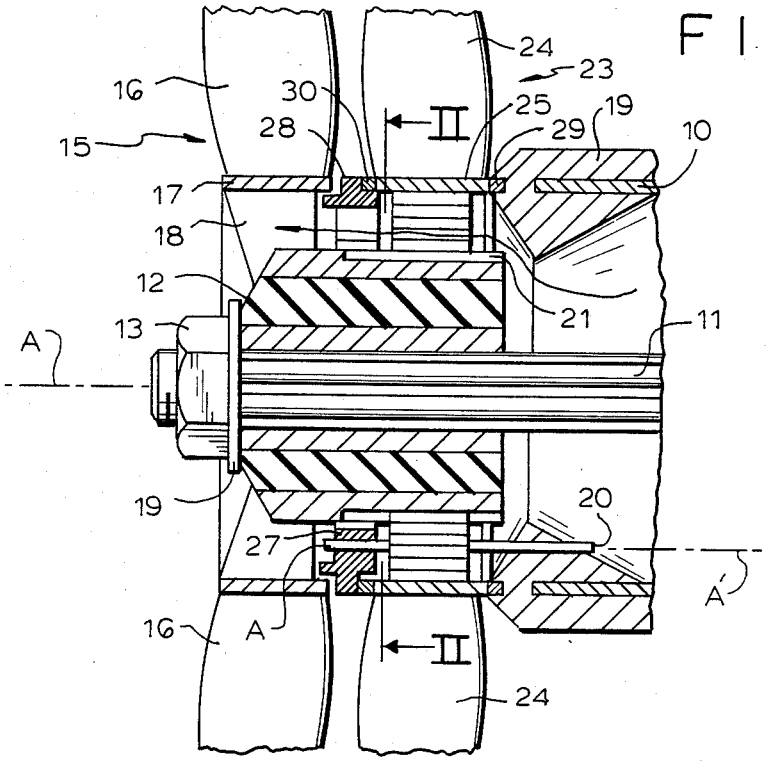
FIG. 1 is an axial section through the drive according to this invention.
Figure 2:
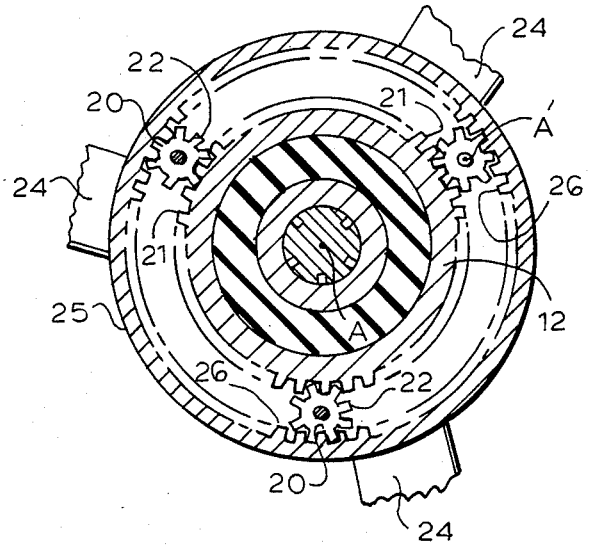
FIG. 2 is a cross section taken along line II—II of FIG. 1.

As seen in FIGS. 1 and 2 a standard lower-drive unit has a drive support tube 19 normally fixed on the outboard drive or on the watercraft itself and extending along a horizontal drive axis A about which is rotated a standard drive shaft 11 having a threaded rear end. The tube 10 forms a passage through which exhaust gases can pass as indicated by the arrow.

The drive according to this invention has a central hub 12 which is splined or keyed to the shaft 11 and secured in place thereon by a nut 13 and washer 14 for rotation about the axis A jointly with the shaft 11 and is of three part construction, that is of two radially spaced and concentric metallic tubes separated by an elastomeric tube. A rear propeller 15 has three standard blades 16 extending radially outward from a ring 17 centered on the axis A and has struts 18 that connect this ring 17 to the massive hub 12. Thus this rear propeller 15 is solidly mounted on this hub 12. The front end of the hub 12 is formed with gear teeth 21 constituting a front sun gear.

The drive further has an annular or tubular support 19 that is formed with a forwardly open annular groove into which the rear end of the tube 10 fits. This support 19 is normally formed as a bracket that engages well forward of the tube 10, around an upright outdrive housing or even to attachment with the watercraft itself. It is therefore substantially stronger than the tube 10 and can be mounted thereon without modifying same. This support 19 carries three planet-pivot pins 20 that extend back from it along respective axes A' angularly and radially equispaced about and from the axis A. Respective small-diameter planet gears 22 are carried on these pins 20 and mesh with the sun gear 21, these pins 20 therefore constituting a stationary planet carrier. The rear ends of the pins 20 are fixed in inwardly projecting lobes 27 of a T-section mounting ring 28 that lies immediately ahead of the rear-propeller ring 17.

A front propeller 23 comprises three blades 24 similar to but of the opposite hand from the blades 16 and carried on a ring 25 formed with internal teeth 26 that also mesh with the teeth of the planet gears 22. In fact the front propeller 23 is radially wholly supported on these gears 22 and radially centered thereby. In addition a front axial-thrust bearing 29 is engaged between the rear end of the support tube 19 and the front end of the propeller ring 25, and a rear axial-thrust bearing 30 is engaged between the front end of the rear mounting ring 28 and the rear end of the propeller ring 25, so that the propeller 23 is thus held against substantially axial displacement on the gears 22.

With this system, therefore, the rear propeller 15 will rotate in the same direction and at the same speed as the shaft 11. The front propeller 23 will rotate in the opposite direction and at a somewhat slower rate, determined by the ratio of the number of teeth 21 to the number of teeth 26. It would be possible to use stepped planetary gears having a large-diameter portion meshing with the sun gear 21 and a small-diameter portion meshing with the ring gear 26 to achieve identical but opposite rotation rates, but different rotation rates have been found quite satisfactory and in fact seem to lessen vibration of the arrangement.

The exhaust gases coming out of the drive-unit tube 10 can easily pass as shown by the arrow axially through the system, between the gears 22 and lobes 27 and thence out between the struts 18. The T-section ring 28 prevents radial outward leakage of the exhaust to minimize cavitation.

This arrangement can readily be retrofitted on an existing outer drive unit whether of the outboard, inboard/outboard, or inboard type. It can be added to a system normally using only one propeller to achieve all the advantages of dual propellers, and in no way interferes with the normal functioning of the related drive elements.

I claim:

1. In combination with a watercraft drive unit having a generally horizontal and annular drive support fixed on the craft and a drive shaft projecting from the rear end of the support and rotatable about a drive axis, a propeller assembly comprising:

a hub fixed on the shaft adjacent the support and having a front hub portion immediately behind the rear support end and a rear portion spaced therefrom;

a rear propeller fixed to the rear portion of the hub;

a planet carrier defining a plurality of planet axes parallel to and spaced equiangularly about the drive axis;

means for securing the carrier to the support for fixing of the planet axes relative to the support and drive axis;

a sun gear fixed on the front portion of the hub within the planet axes and axially between the rear hub portion and the rear support end;

respective planet gears meshing with the sun gear and rotatable on the carrier about the planet axes axially between the rear hub portion and the rear support end; and a front propeller surrounding the planet gears, lying between the rear propeller and the rear support end, and formed internally as a ring gear meshing with the planet gears, whereby rotation of the drive shaft in one direction rotates the rear propeller and sun gear in the same direction and rotates the planet gears and front propeller in the opposite direction.

2. The counterrotating dual-propeller drive defined in claim 1 wherein the sun gear is unitarily formed on the hub.

3. In combination with a watercraft drive unit having a generally horizontal and annular drive support fixed on the craft and a drive shaft projecting from the rear end of the support and rotatable about a drive axis, the drive support forming a rearwardly directed exhaust port, a propeller assembly comprising:

a hub fixed on the shaft adjacent the support and having a front hub portion immediately behind the rear support end and a rear portion spaced therefrom;

a rear propeller fixed to the rear portion of the hub;

a planet carrier defining a plurality of planet axes parallel to and spaced equiangularly about the drive axis;

means for securing the carrier to the support for fixing of the planet axes relative to the support and drive axis;

a sun gear fixed on the front portion of the hub within the planet axes and axially between the rear hub portion and the rear support end;

respective planet gears meshing with the sun gear and rotatable on the carrier about the planet axes axially between the rear hub portion and the rear support end, the planet carrier, planet gears, and rear propeller forming at least one axially throughgoing passage aligned with the port, whereby the vented exhaust can pass axially through the drive; and a front propeller surrounding the planet gears, lying between the rear propeller and the rear support end, and formed internally as a ring gear meshing with the planet gears, whereby rotation of the drive shaft in one direction rotates the rear propeller and sun gear in the same direction and rotates the planet gears and front propeller in the opposite direction.

4. In combination with a watercraft drive unit having a generally horizontal and annular drive support fixed on the craft and a drive shaft projecting from the rear end of the support and rotatable about a drive axis, a propeller assembly comprising:

a hub fixed on the shaft adjacent the support and having a front hub portion immediately behind the rear support end and a rear portion spaced therefrom;

a rear propeller fixed to the rear portion of the hub;

a planet carrier defining a plurality of planet axes parallel to and spaced equiangularly about the drive axis;

means including a rigid support tube snugly and coaxially surrounding the drive support for securing the carrier to the support for fixing of the planet axes relative to the support and drive axis;

a sun gear fixed on the front portion of the hub within the planet axes and axially between the rear hub portion and the rear support end;

respective planet gears meshing with the sun gear and rotatable on the carrier about the planet axes axially between the rear hub and the rear support end; and a front propeller surrounding the planet gears, lying between the rear propeller and the rear support end, and formed internally as a ring gear meshing with the planet gears, whereby rotation of the drive shaft in one direction rotates the rear propeller and sun gear in the same direction and rotates the planet gears and front propeller in the opposite direction.

5. The counterrotating dual-propeller drive defined in claim 4 wherein the securing means includes an axial-thrust bearing between the front propeller and the support tube.

6. The counterrotating dual-propeller drive defined in claim 5 wherein the securing means includes a support ring between the propellers and fixed on the carrier, and pivot pins carrying the planet gears and fixed at their front ends in the support tube and at their rear end in the support ring.

7. The counterrotating dual-propeller drive defined in claim 6 wherein the support means further includes an axial-thrust bearing between the front propeller and the support ring.

8. The counterrotating dual-propeller drive defined in claim 1 wherein the sun gear is integrally formed on the front hub portion.

* * * * *